US006780553B2

(12) United States Patent
Sugimura et al.

(10) Patent No.: US 6,780,553 B2
(45) Date of Patent: Aug. 24, 2004

(54) ELECTROPHOTOGRAPHIC PHOTORECEPTOR AND MANAGEMENT SYSTEM OF THE SAME

(75) Inventors: Hiroshi Sugimura, Habikino (JP); Kenichi Nagata, Shiki-gun (JP); Masanori Matsumoto, Kashihara (JP); Yoshimi Kojima, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/328,182

(22) Filed: Dec. 26, 2002

(65) Prior Publication Data

US 2003/0124445 A1 Jul. 3, 2003

(30) Foreign Application Priority Data

Dec. 27, 2001 (JP) ..... P2001-398009

(51) Int. Cl.[7] ..... G03G 15/00
(52) U.S. Cl. ..... 430/56; 399/12
(58) Field of Search ..... 430/56; 399/8, 399/10, 12

(56) References Cited

U.S. PATENT DOCUMENTS 5,536,607 A 7/1996 Ohashi et al.
6,385,407 B1 5/2002 Inose
6,560,414 B2 * 5/2003 Suda et al. ..... 399/12

FOREIGN PATENT DOCUMENTS

| | | | |
|---|---|---|---|
| JP | 6-35258 | A | 2/1994 |
| JP | 2882210 | B2 | 2/1999 |
| JP | 2886749 | B2 | 2/1999 |
| JP | 2000-246921 | A | 9/2000 |
| JP | 2001-117309 | A | 4/2001 |

* cited by examiner

*Primary Examiner*—John L Goodrow
(74) *Attorney, Agent, or Firm*—Nixon & Vanderhye P.C.

(57) ABSTRACT

An object of the present invention is to provide an electrophotographic photoreceptor capable of recording management information for managing the electrophotographic photoreceptor in a noncontact manner, and improving management of the electrophotographic photoreceptor. An electrophotographic photoreceptor includes a conductive base, a photosensitive layer and a flange portion, wherein a noncontact information medium provided with an antenna part which communicates in a noncontact manner with a reader/writer of a main body of an electrophotographic image forming apparatus and a control part which stores management information for managing the electrophotographic photoreceptor and controls the antenna part so as to communicate with the reader/writer is disposed onto the conductive base.

16 Claims, 3 Drawing Sheets

ELECTROPHOTOGRAPHIC PHOTORECEPTOR AND MANAGEMENT SYSTEM OF THE SAME

BACKGROUND OF THE INVENTION

1. Field of the Invention

The present invention relates to an electrophotographic photoreceptor which enables obtaining a high-image-quality and high-quality image by a correct use, and a management system which manages a correct use of the same.

2. Description of the Related Art

Because having immediacy and enabling obtaining an image of high quality and good keeping, the electrophotographic technique invented by C. F. Carlson is widely used not only in the field of copying machines but also in the fields of various kinds of printers and facsimiles recently, and spread wide.

Regarding a photoreceptor, which is a core of the electrophotographic technique, as a photoconductive material thereof, an inorganic photoconductive material such as Se, As—Se alloy, CdS or ZnO has been used up to now, and recently, a photoreceptor made of an organic photoconductive material having merits such as being free from pollution, being easy to deposit and produce and allowing material selection from a wide range, which cannot be seen in the inorganic material, has been developed.

The durability of the organic photoreceptor has been dramatically increased in recent years. However, countermeasures against a change of a film thickness due to mechanical abrasion, a change of sensitivity according to a use environment and so on are not complete, and in order to cover these performances, methods that main body equipment detects and compensates the changes have been adopted.

As one of the methods, there is a proposed method which enables obtaining a good image at all times by: disposing a mark part made by differentiating a reflectivity of part of a photoreceptor surface so as to enable definition of the position thereof by reading the reflectivity difference with a photodiode; measuring toner concentration in the same position on the photoreceptor at all times; and compensating deterioration of an image based on electrostatic charge potential, development bias, exposure strength and so on. For example, in Japanese Patent Publications No. 2882210 and No. 2886749, one example of this proposal is disclosed.

However, in the above prior art, process control including information on a change of a photoreceptor formula or variation among lots is impossible, and all that is possible is a temporary adjustment of image quality. Moreover, although it is possible to know a life from a counter on the apparatus main body side, there is such a problem that correct process control cannot be executed because a history is unavailable, for example, in a case where a memory of the main body is erased because of trouble, or in a case where, when the main body gets out of order and cannot be used, the photoreceptor is reused in another main body.

Further, in Japanese Unexamined Patent Publication JP-A 6-35258 (1994), a method of storing the number of sheets with images formed and so on in a nonvolatile memory provided in a photoreceptor unit is proposed. However, since an electrophotographic photoreceptor is usually dealt alone, storing in a photoreceptor unit needs a complicated operation such as resetting an IC chip for every replacement of a photoreceptor. Moreover, there is a possibility of misusing a unit using an inferior photoreceptor by mistake.

Furthermore, since the main body and the unit are connected by a connector and exchange information for every replacement, there is a problem that such a matter that transmission/reception of data cannot be performed or data is lost because of abrasion and deformation of a contact and so on is easy to arise.

Recently, for example, in Japanese Unexamined Patent Publication JP-A 2000-246921 (2000), a noncontact type of recording medium instead of a contact type described above is developed, and a method of recording information of consumable goods such as a photoreceptor and toner into a noncontact recording medium and using consumable goods suitable for a main body in an optimal condition is proposed.

However, in this case, the problem in the case of storing in a photoreceptor unit as described before is not solved, and furthermore, as copiers and printers are rapidly spread, corresponding consumable goods such as a photoreceptor and toner flood the market, so that a problem that a desired image cannot be obtained and trouble that a main body gets out of order often arise because of use of an inferior photoreceptor.

Accordingly, for example, in Japanese Unexamined Patent Publication JP-A 2001-117309 (2001), it is proposed to attach a noncontact recording medium with information stored to an electrophotographic photoreceptor. However, in this case, a fixture place of the noncontact recording medium is a flange part, and since application of a photosensitive layer is performed in a clean room and attachment of a flange part is performed in a normal environment in general in production of an electrophotographic photoreceptor, these are usually performed in other places or other plants, and information transmission between both the plants becomes complicated, so that a mistake of stored information due to a mistake of attachment of a flange is easy to arise.

SUMMARY OF THE INVENTION

The present invention was made in consideration of the conditions mentioned above, and an object of the invention is to provide an electrophotographic photoreceptor capable of recording management information for managing the electrophotographic photoreceptor in a noncontact state and improving management of the electrophotographic photoreceptor.

Another object of the invention is to provide an electrophotographic photoreceptor in which management information of the electrophotographic photoreceptor is stored without errors and with increased precision.

A further object of the invention is to provide a management system of an electrophotographic image forming apparatus in which management system management information for managing an electrophotographic photoreceptor is kept by a main body of the electrophotographic image forming apparatus and an appropriate action is taken in accordance with conditions and type of the electrophotographic photoreceptor.

In order to solve the aforementioned problems, the invention is constituted as follows.

The invention provides an electrophotographic photoreceptor used in an electrophotographic image forming apparatus for forming an image on a recording medium, the electrophotographic photoreceptor comprising:

a conductive base;

a photosensitive layer formed on the conductive base; and a noncontact information medium disposed on the conductive base or photosensitive layer, the noncontact information medium being provided with an antenna part which communicates with main body communication means of a main body of the electrophotographic image forming apparatus in a noncontact state and a control part which stores management information for managing the electrophotographic photoreceptor and controls the antenna part so as to communicate with the main body communication means.

According to the invention, the main body communication means and the noncontact information medium do not contact each other, and therefore, there is no glitch due to abrasion of a contact, grime of a contact and so on by use. Consequently, correct information of the electrophotographic photoreceptor is stored in the recording medium, the main body is capable of setting an optimal image forming process based on this information, and it is possible to obtain a good image.

Further, since the noncontact information medium exists on the conductive base, it is possible to input information of the photosensitive layer itself in real time at the time of producing the photosensitive layer, which is a convenience, and it is also possible to prevent a mistake of stored information due to a mistake of attachment of a flange.

In the invention it is preferable that the noncontact information medium stores at least one of information of number of use of the electrophotographic photoreceptor, information of use conditions of the electrophotographic photoreceptor in the main body, ID information of a manufacturer of the electrophotographic photoreceptor, and information of inspection history of the electrophotographic photoreceptor.

According to the invention, the information can be rewritten from outside, and therefore, it is possible to update the information in accordance with the degree of use, it is possible at all times to keep a present state of the electrophotographic photoreceptor in the main body, and it is possible to immediately respond component sharing.

In the invention it is preferable that the control part and the antenna part of the noncontact information medium are made up by one IC chip.

According to the invention, it is easy to mount because wiring is not required, and it is possible to prevent occurrence of a failure such as a disconnection.

In the invention it is preferable that the electrophotographic photoreceptor comprises authentication means for authenticating access information inputted from the main body communication means, and access control means for allowing communication between the noncontact information medium and the main body communication means when the access information is authenticated by the authentication means.

According to the invention, transmission/reception of data is performed after authentication of access information, and therefore, it is possible to prevent alteration and disappearance of data due to a misuse.

In the invention it is preferable that the noncontact information medium is fixed to the surface of the photosensitive layer of the electrophotographic photoreceptor.

According to the invention, it is possible to fix the noncontact information medium in a simple manner after production of the electrophotographic photoreceptor.

In the invention it is preferable that the noncontact information medium is fixed to the surface of the conductive base of the electrophotographic photoreceptor.

According to the invention, the photosensitive layer also functions as a protection film of the noncontact information medium, so that it is possible to prevent exfoliation and hiatus, and it is possible to protect the IC chip from a scratch and shock.

In the invention it is preferable that the conductive base is a resin.

According to the invention, it is possible to easily dispose a concave part to the conductive base, it is possible by fixing the noncontact information medium thereto to make away with irregularity of the surface of the photoreceptor, it is possible to smoothly clean, and it is possible to prevent toner scattering or occurrence of a noise due to a contact with the main body.

In the invention it is preferable that a fixture position of the noncontact information medium on the electrophotographic photoreceptor exists outside all areas of charging means for charging the electrophotographic photoreceptor, developing means for developing an electrostatic latent image formed on the electrophotographic photoreceptor, transferring means for transferring a developed image to a recording medium, and cleaning means for removing toner residue.

According to the invention, it is possible to prevent electrostatic charge at a convex part of a place fixing the noncontact information medium, unevenness of development and cleaning fault, and it is possible to prevent occurrence of a failure because the noncontact information medium itself is not subjected to electrical and mechanical stress.

In the invention it is preferable that the photosensitive layer includes an undercoat layer disposed onto the conductive base, a charge generating layer disposed onto the undercoat layer, and a charge transfer layer disposed onto the charge generating layer, and the noncontact information medium is fixed to the surface of the charge transfer layer.

In the invention it is preferable that the photosensitive layer includes an undercoat layer disposed onto the conductive base, a charge generating layer disposed onto the undercoat layer, and a charge transfer layer disposed onto the charge generating layer, and the noncontact information medium is fixed to the surface of the conductive base and disposed away from the photosensitive layer.

In the invention it is preferable that the photosensitive layer includes an undercoat layer disposed onto the conductive base, a charge generating layer disposed onto the undercoat layer, and a charge transfer layer disposed onto the charge generating layer, and the noncontact information medium is fixed to the surface of the conductive base and coated with the charge transfer layer.

The invention provides a management system used in a main body of an image forming apparatus which main body accommodates an electrophotographic photoreceptor, comprising:

the electrophotographic photoreceptor; and a mechanism for rewriting or reading information of the noncontact information medium, wherein communication with the noncontact information medium is carried out when a charge voltage to charging means for charging the electrophotographic photoreceptor and a development voltage to developing means for developing an electrostatic latent image formed on the electrophotographic photoreceptor are not applied.

According to the invention, it is possible to communicate without errors without being affected by power source noise.

The invention provides a management system used in a main body of an image forming apparatus which main body accommodates an electrophotographic photoreceptor, comprising:

the electrophotographic photoreceptor; and a mechanism for rewriting and reading information of the noncontact information medium, wherein when according to a judgment on the main body side, information stored in the noncontact information medium is judged as being abnormal, a necessary action is taken.

According to the invention, it is possible to prevent mounting to a nonconforming model by mistake and misusing an inferior photoreceptor, and perform normal image forming at all times.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
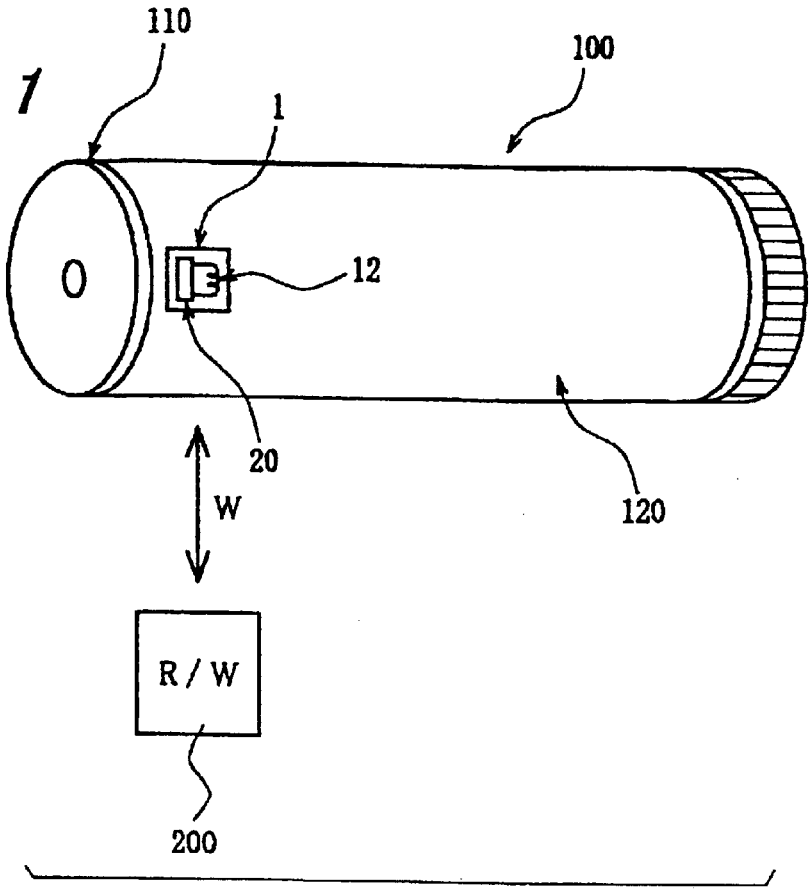
FIG. 1 is a perspective description view showing a relation between a photoreceptor drum, which is an electrophotographic photoreceptor relating to an embodiment of the present invention, and a reader/writer, which is an external connection device.

Now referring to the drawings, preferred embodiments of the invention are described below.

Referring to the drawings, an electrophotographic photoreceptor and a management system of the same relating to an embodiment of the present invention will be described below in detail. In the respective views, members marked with the same reference numeral represent the same member, and a repeat of an explanation thereof will be omitted.

As shown in FIG. 1, an electrophotographic photoreceptor 100 has a conductive base 110, a photosensitive layer 120 formed thereon, and a noncontact information medium 1. The noncontact information medium 1 is caused to communicate in a noncontact state with a reader/writer 200 serving as main body communication means disposed outside, by the use of an electromagnetic wave, for example, an electric wave W. The reader/writer 200 is installed on a unit such as a process cartridge, a photoreceptor cartridge or a development cartridge or an external apparatus such as a copier or a printer.

As the conductive base 110 of the electrophotographic photoreceptor 100, it is possible to use, for example, a metal material such as aluminum, aluminum alloy, stainless steel, iron, gold, silver, copper, zinc, nickel or titanium, a plastic base substance onto which aluminum, gold, silver, copper, nickel, indium oxide, tin oxide or the like is evaporated, a polyester film, plastic containing paper or conductive particles, plastic containing paper or conductive polymer, and so on. As a shape thereof, it is possible to use a drum shape, a sheet shape, a seamless belt shape and so on. In the electrophotographic photoreceptor 100 of the embodiment shown in FIG. 1, the conductive base 110 is formed like a drum.

Figure 4:
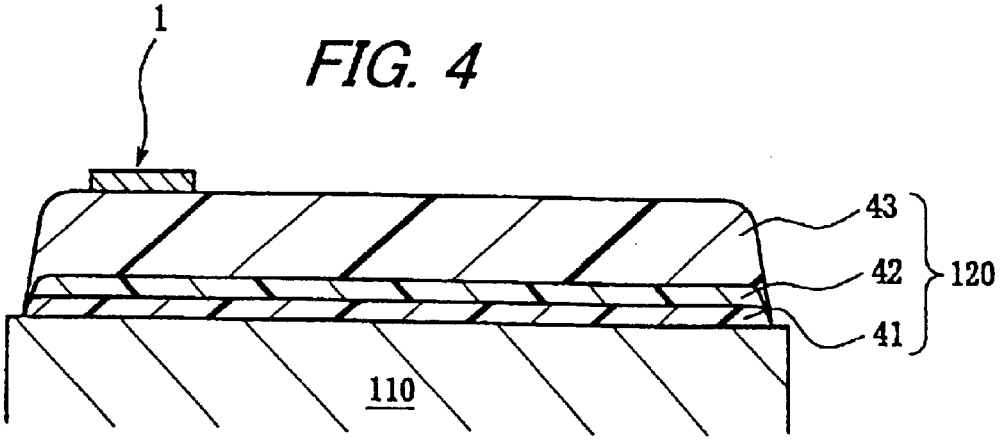
FIG. 4 is a section view of an electrophotographic photoreceptor relating to an embodiment of the invention.
Figure 5:
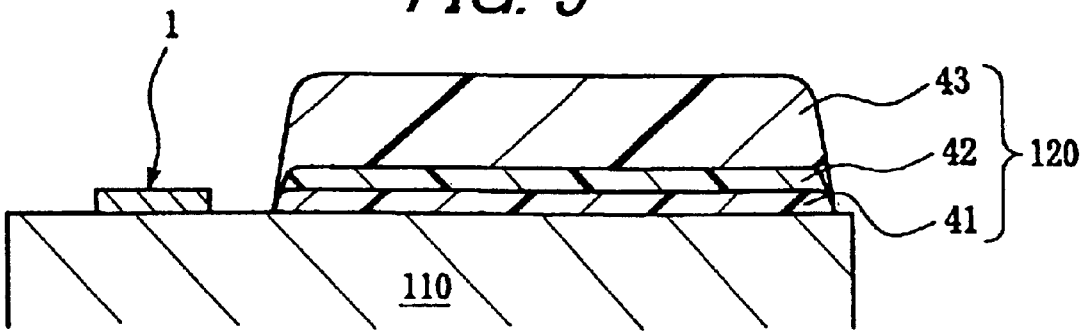
FIG. 5 is a section view of an electrophotographic photoreceptor relating to another embodiment of the invention.

The photosensitive layer 120 of the electrophotographic photoreceptor 100 includes, for example, like a lamination type electrophotographic photoreceptor shown in FIG. 4 or FIG. 5, an undercoat layer 41 as an intermediate layer disposed onto the conductive base 110, a charge generating layer 42 disposed onto the undercoat layer 41, and a charge transfer layer 43 disposed onto the charge generating layer 42.

As a material of the undercoat layer 41, polyamide, copolymer nylon, polyvinyl alcohol, polyurethane, polyester, epoxy, a phenol resin, casein, cellulose, gelatin and so on have been known up to now, and particularly, alcohol-soluble copolymer nylon is often used.

These are dissolved into water and various kinds of organic solvents, particularly, a single solvent of water, methanol, ethanol or butanol, or a mixed solvent of water/alcohol or two or more kinds of alcohols, or a mixed solvent of a chlorinated solvent such as dichloroethane, chloroform, trichloroethane, trichloroethylene or perchloroethylene and alcohol, and applied to the surface of the conductive base 110.

Moreover, it is known to make dispersedly contain inorganic pigment such as zinc oxide, titanium oxide, tin oxide, indium oxide, silica or antimony oxide as necessary especially for the reasons of the setting of volume resistivity of the undercoat layer 41, improvement of a repeat aging characteristic under a low-temperature/low-humidity condition, and so on.

These are dispersed and dissolved into the aforementioned various kinds of organic solvents, and applied by soak onto the conductive base 110 so that a film thickness reaches about 0.1–5 $\mu$m. In the case of dispersing inorganic pigment in the undercoat layer 41 serving as an intermediate layer, an embodiment of not covering the noncontact information medium is preferable in consideration of transmissiveness of an electromagnetic wave.

The charge generating layer 42 contains a charge generating material which generates charge by irradiation with light as a major component, and contains a well-known binder, plasticizer and sensitizer as necessary. A charge generating material is perylene pigment such as perylene-imide or perylene acid anhydride, polycyclic quinone pigment such as quinacridone or anthraquinone, phthalocyanine pigment such as metal and metal-free phthalocyanine or halogenated metal-free phthalocyanine, squarylium dye, azulenium dye, thiapyrylium dye, azo pigment having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton or distyrylcarbazole skeleton, and so on.

Although a production method of the charge generating layer 42 is a method of directly depositing a compound by vacuum evaporation or a method of depositing by dispersing into a binder resin solution and applying, the latter method is preferable in general, and a film thickness of the charge generating layer 42 is 0.05–5 $\mu$m, preferably, 0.1–1 $\mu$m.

In the case of production by application, a method of mixing and dispersing a charge generating agent into a binder resin solution and an application method are the same as in the case of the undercoat layer 41. Moreover, a binder resin for a binder resin solution is a melamine resin, an epoxy resin, a silicon resin, a polyurethane resin, an acrylic resin, a polyvinyl chloride acetate copolymer resin, a polycarbonate resin, a phenoxy resin, or the like. As a solvent for dissolving these resins, ketone such as acetone, methyl ethyl ketone or cyclohexanone, ester such as ethyl acetate or butyl acetate, ether such as tetrahydrofuran or dioxane, aromatic hydrocarbon such as benzene, toluene or xylene, an aprotic polar solvent such as N,N-dimethylformamide or dimethylsulfoxide, or the like can be used.

As a charge transfer material of the charge transfer layer 43 disposed onto the charge generating layer 42, a hydrazone compound, a pyrazoline compound, a triphenylamine compound, a triphenylmethane compound, a stilbene compound, an oxydiazole compound or the like can be used, and an application fluid for a charge transfer layer is produced by dissolving a charge transfer material into a binder resin solution. As an application method of the charge transfer layer 43, the same method as in the case of the undercoat layer 41 is used.

The photosensitive layer 120 of an electrophotographic photoreceptor drum may contain one kind or two or more kinds of electron acceptor materials and/or dye for the purpose of improving sensitivity and inhibiting increase of residual potential and fatigue when used repeatedly. As an electron acceptor material used here, for example, acid anhydride such as succinic anhydride, maleic anhydride, phthalic anhydride or 4-chloronaphthyl acid anhydride, a cyano compound such as tetracyanoethylene or terephthalmalondinitrile, aldehyde such as 4-nitrobenzaldehyde, anthraquinone such as anthraquinone or 1-nitroanthraquinone, a polycyclic or heterocyclic nitro compound such as 2,4,7-trinitrofluorenone or 2,4,5,7-tetranitrofluorenone can be used, which can be used as a chemical sensitizer.

As dye, for example, an organic photoconductive compound such as xanthene dye, thiazine dye, triphenylmethane dye, quinoline pigment or copper phthalocyanine can be used, and these dyes can be used as an optical sensitizer.

Furthermore, the photosensitive layer 120 may contain a well-known plasticizer to increase formability, flexibility and mechanical strength. A plasticizer is dibasic acid ester, fatty ester, phosphoric ester, phthalate ester, chlorinated paraffin, an epoxy type plasticizer and so on. Moreover, a leveling agent, an antioxidant, an ultraviolet absorption agent and so on may be contained as necessary.

The noncontact information medium 1 may be coated with a resin, or coated with the photosensitive layer 120, or in a case where the conductive base 110 is plastic, may be buried therein. Thus, the noncontact information medium 1 is protected from dust, scattering toner, a developer and so on. Moreover, it is possible by coating to physically prevent an unauthorized person from easily taking out the noncontact information medium 1.

The noncontact information medium 1 is fixed near one end on the conductive base 110 or the photosensitive layer 120 by an adhesive, a tape or the like as shown in FIG. 1.

The charging means may be an electrostatic charger, an electrostatic charge roller or the like. The developing means may be nonmagnetic monocomponent development, two-component development or the like. The transferring means may be a transfer charger, a transfer roller or the like. In the embodiment shown in FIG. 1, a fixture position of the noncontact information medium 1 is preferably one end in the axial direction of the electrophotographic photoreceptor 100, where these high-voltage electrical fields are not applied. Moreover, cleaning means may be a cleaning blade, a fur brush, a magnetic brush or the like. So as not to obstruct cleaning, a fixture position of the noncontact information medium 1 is preferably one end in the axial direction of the electrophotographic photoreceptor 100.

Figure 6:
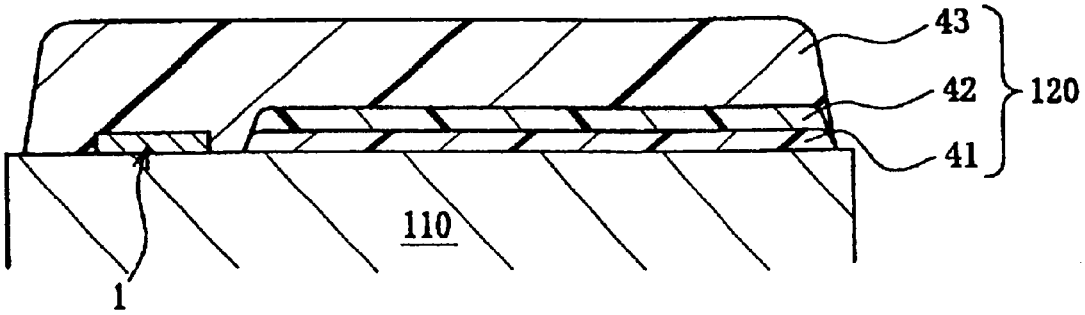
FIG. 6 is a section view of an electrophotographic photoreceptor of still another embodiment of the invention.
Figure 7:
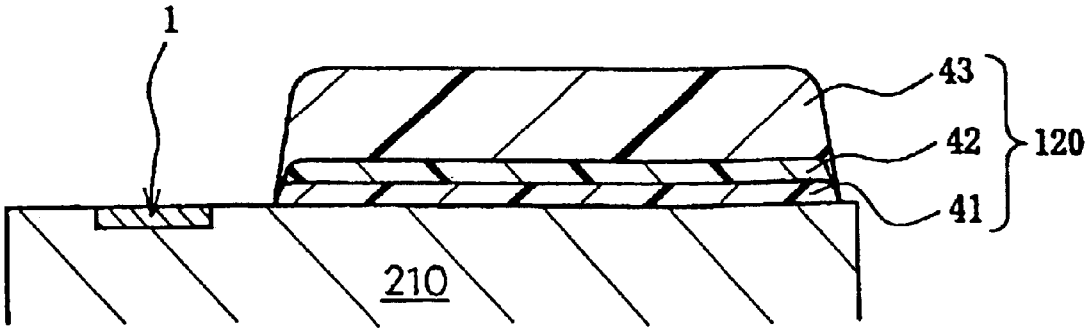
FIG. 7 is a section view of an electrophotographic photoreceptor of still another embodiment of the invention.

The noncontact information medium 1 is attached by, for example, applying the photosensitive layer 120 and then fixing the noncontact information medium 1 onto the surface of the photosensitive layer 120 as shown in FIG. 4, or fixing the noncontact information medium 1 onto the conductive base 110 and then applying the photosensitive layer 120 so as to avoid this part as shown in FIG. 5, or fixing the noncontact information medium 1 onto the conductive base 110 and then applying so as to cover only the charge transfer layer as shown in FIG. 6.

Because communicating in a noncontact manner with the reader/writer 200 (refer to FIG. 1), which is part of the external apparatus, by the use of an electromagnetic wave described later, the noncontact information medium 1 does not have a terminal, a connector or the like connected to the external apparatus, and is sealed. Consequently, there is no possibility that the noncontact information medium 1 is destroyed or contaminated from outside via such a terminal or the like.

Figure 2:
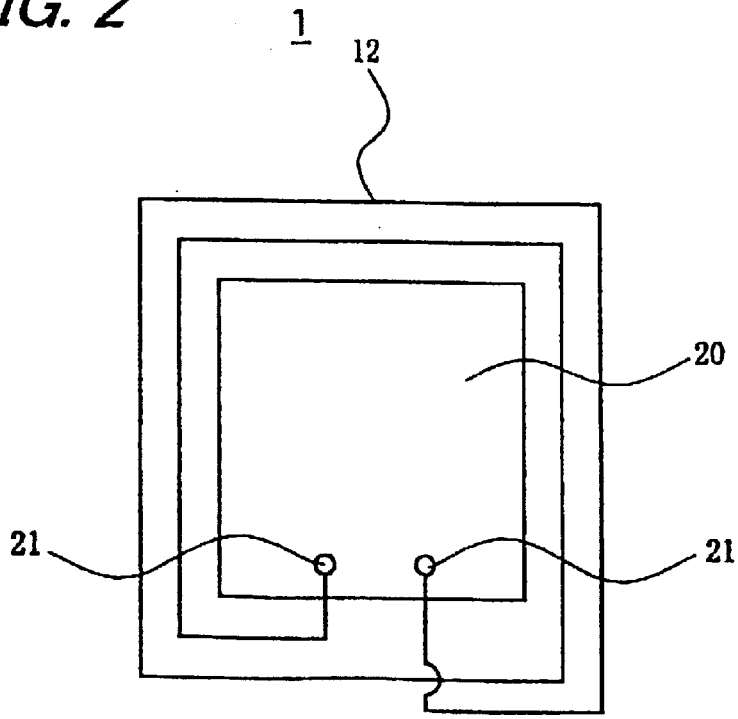
FIG. 2 is a plan view showing a specific example of the noncontact information medium.
Figure 3:
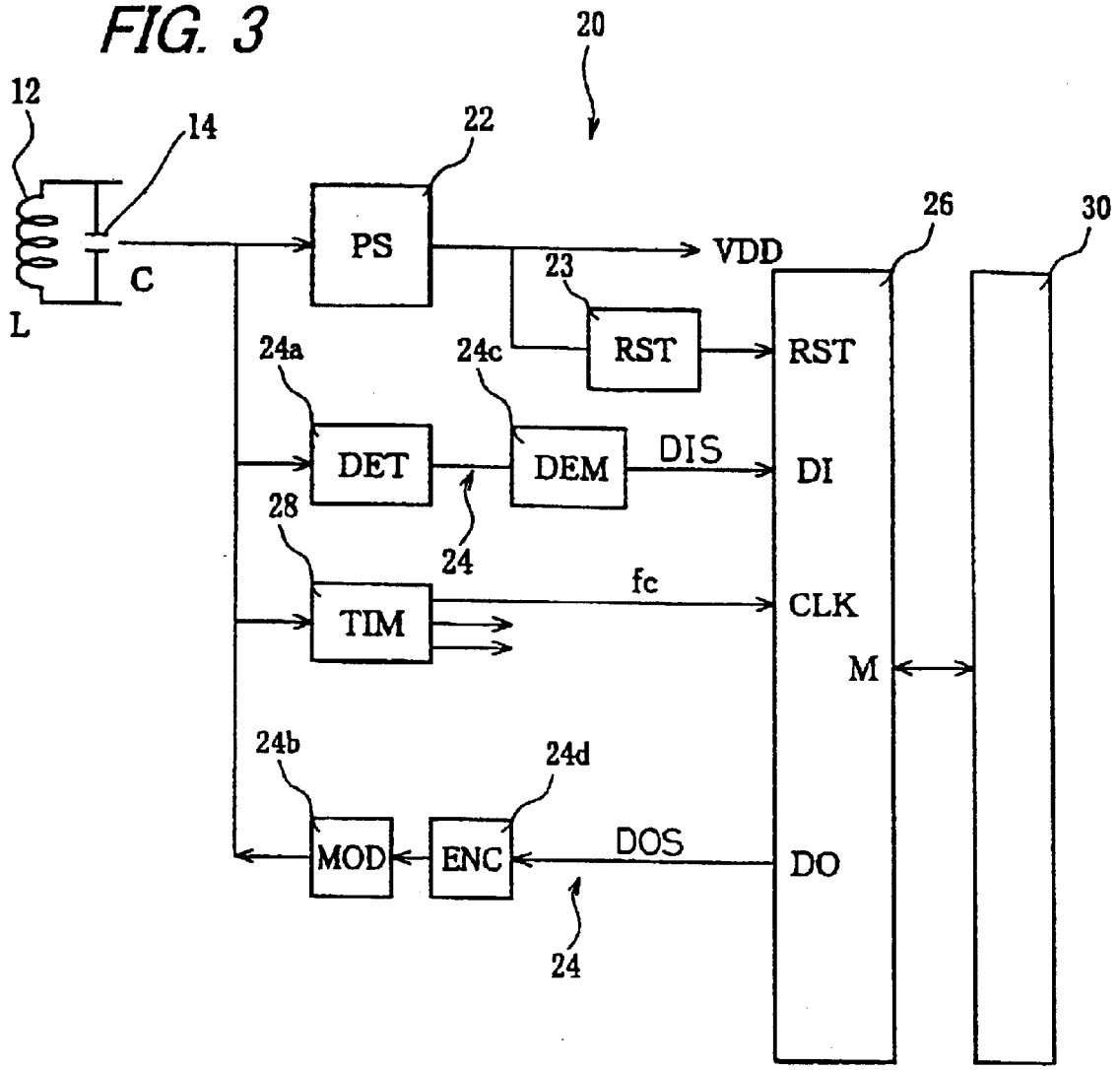
FIG. 3 is a schematic block diagram showing the details of a noncontact interface part of the noncontact information medium.

Referring to FIGS. 2, 3, the construction of the noncontact information medium 1 will be described below. Here, FIG. 2 is a schematic plan view showing a specific construction of the noncontact information medium 1 shown in FIG. 1, and FIG. 3 is a schematic block diagram showing the details of an IC chip 20 of the noncontact information medium 1 shown in FIG. 1.

An antenna coil (an antenna part) 12 is electromagnetically coupled to a coil of the reader/writer 200 in a noncontact manner, and communication with the reader/writer 200 is performed by an electromagnetic wave having an arbitrary frequency band of carrier frequency fc (for example, 13.56 MHz), for example, an electric wave W. The antenna coil 12 may simultaneously use a subcarrier frequency when necessary.

FIG. 1 notionally shows the antenna coil 12. In the actual noncontact information medium 1, the antenna coil 12 is formed, for example, as shown in FIG. 2, so as to surround the IC chip 20. The shape of the antenna coil 12 when viewed from above can be a desired shape such as a circle, a quadrangle or an oval.

The antenna coil 12 is electrically connected to a pair of connecting terminals 21 of the IC chip 20 by a wire bonding method, a TAB (tape automated bonding) method or the like. A communication distance between the antenna coil 12 and the reader/writer 200 is, for example, several to dozens of centimeters.

The antenna coil 12 can be formed by any method well known to those skilled in the art such as etching by the use of copper, aluminum or the like, printing by a print wiring method, or forming by a wire. The antenna coil 12 has a desired size, shape, self-inductance and mutual inductance in accordance with a packaging area and other conditions.

The invention allows application of an antenna well known to those skilled in the art such as a dipole antenna, a monopole antenna, a loop antenna, a slot antenna, a microstrip antenna or the like, instead of the antenna coil 12. Moreover, a coil-on-chip type that the antenna coil 12 is formed on the IC chip 20 by microfabrication enables reduction in cost and size.

Referring to FIG. 3, the antenna coil 12 is preferably connected to a resonance capacitor 14. The capacitor 14 has capacitance C, and is used for forming a resonance circuit which resonates with the carrier frequency fc of an electric wave for transmission/reception, in consort with inductance L of the antenna coil 12.

Since a resonance frequency fr formed by the coil 12 and the capacitor 14 is $fr=(1/2\pi)(LC)^{-1/2}$, it is possible by matching this with the carrier frequency fc to feed a large resonance current through the coil 12 and the capacitor 14, and it is possible to supply the resonance current to the IC chip 20. A forming position of the capacitor 14 may be on the same plane as each component of the IC chip 20 described below (that is, like a single layer), or may be thereon (that is, like a multilayer).

As shown in FIG. 3, the IC chip 20 has a power source circuit 22, a reset signal generating circuit 23, a transmission/reception circuit 24, a logic control circuit 26 as a control part, a timing circuit (TIM) 28, and a memory 30, and communicates with the reader/writer 200 to read out of and write in the memory 30.

To the power source circuit (PS) 22, the reset signal generating circuit (RST) 23 is connected, and the reset signal generating circuit 23 is connected to a reset terminal (RST) of the logic control circuit 26. The IC chip 20 supplies, to each logic, a communication system operation voltage Vcc (for example, 5 V) from the electric wave W (the carrier frequency fc) received from the reader/writer 200 by electromagnetic induction. When operation power Vcc is generated, the reset signal generating circuit 23 resets the logic control circuit 26 and makes ready for a new operation.

The transmission/reception circuit 24 includes a detector (DET) 24*a*, a modulator (MOD) 24*b*, a demodulator (DEM) 24*c*, and an encoder (ENC) 24*d*. The demodulator 24*c* and the encoder 24*d* are connected to a data input terminal DI and a data output terminal DO of the logic control circuit 26, respectively. When necessary, a decoder made up by a D/A converter or the like may be placed subsequently to the demodulator 24*c* as an independent member. The timing circuit (TIM) 28 is used for generating various kinds of timing signals, and connected to a clock terminal (CLK) of the logic control circuit 26.

A reception part of the transmission/reception circuit 24 is made up by the detector 24*a* and the demodulator 24*c*. The received electric wave W is detected by the detector 24*a*. To obtain data from a detection signal, a base band signal is restored by the demodulator 24*c*. A restored base band signal (when necessary, a signal decoded thereafter) is sent to the logic control circuit 26 as a data input signal DIS.

A transmission part of the transmission/reception circuit 24 is made up by the modulator 24*b* and the encoder 24*d*. Regarding the modulator 24*b* and the encoder 24*d*, any configuration well known to those skilled in the art can be used. A carrier wave is changed in accordance with transmission data, and the data is transmitted to the coil 12.

As a modulation method, for example, ASK of changing an amplitude of a carrier frequency, PSK of changing a phase or the like can be used, and also load modulation can be used. Load modulation is a method of modulating medium electric power (load) in accordance with a transmission signal. The encoder 24*d* encodes a data output signal DOS to be transmitted by a specified code (for example, Manchester encoding, PSK encoding or the like) (bit encoding). Then, an encoded signal is modulated in the modulator 24*b* and transmitted to the antenna coil 12.

The transmission/reception circuit 24 is controlled by the logic control circuit 26 to operate in synchronization with a timing signal (clock) generated by the timing circuit 28. The logic control circuit 26 can be implemented by a CPU.

The memory 30 is made up by a ferroelectric memory which stores various kinds of data such as a read-only-memory (ROM), a random-access-memory (RAM), EEPROM and/or FRAM (trademark) When the memory 30 is made up as a nonvolatile memory, it is allowed that stored data is read out by the reader/writer 200, whereas it is prevented that the data is changed.

Alternatively, the memory 30 may be made up as a rewritable-type memory, and the logic control circuit 26 may control access from the reader/writer 200 like a software. More specifically, for example, the memory 30 may be used as authentication means which authenticates access information inputted from the reader/writer 200, and the logic control circuit 26 may be caused to function as access control means which allows communication between the noncontact information medium 1 and the reader/writer 200 when the access information is authenticated by the authentication means. Like this, the noncontact information medium 1 can communicate with the reader/writer 200 based on the data, and the logic control circuit 26 can execute a specified process.

The memory 30 is capable of storing one or a plurality of information of information on the ID number of the electrophotographic photoreceptor 100 (a manufacturer ID, a department, address, telephone number, fax number and e-mail address of a manufacturer, a lot number of a product, date of manufacture and so on), the life of the photoreceptor (for example, three hundred thousand A4-size sheets), a storage expiration time (within three years after manufacture or the like), a working temperature and humidity, a list of usable copiers and printers, a remedy in the event of trouble and so on, and information including the number of sheets and time actually used and composition information of the photoreceptor.

As described above, by storing various kinds of data required for a management system described later into the memory 30, the invention increases reliability of data as compared with a case of recording such data artificially. Information stored in the memory 30 may be protected in code as necessary.

The respective components of the noncontact information medium 1 may be constructed as separate IC chips, or may be constructed by a one-chip monolithic semiconductor device. In a construction of forming a coil on an IC chip as a one-chip IC by microfabrication, an outgoing line is not needed outside the IC chip, and the construction is exceedingly simple.

Therefore, it is possible to economize circuit cost and assembly cost, and it is possible to largely increase reliability of the circuit. Moreover, a problem of disconnection of a connection terminal due to a bend of wiring and the like is eliminated, which is preferable.

Referring to FIGS. 4 to 7, examples of the invention will be specifically described below, whereas the embodiment of the invention is not limited thereby. In FIGS. 4 to 7, thicknesses of the respective layers 41, 42, 43 of the photosensitive layer 120 are shown with exaggeration in order to facilitate illustration.

EXAMPLE 1

7 pts. wt. of titanium oxide (produced by Ishihara Sangyo Kaisha, Ltd.: TTO55A) and 13 pts. wt. of copolymer nylon (produced by Toray Industries, Inc.: CM8000) were added to a mixed solvent of 159 pts. wt. of methyl alcohol and 106 pts. wt. of 1,3-dioxolane, and subjected to a dispersion process for eight hours in a paint shaker, whereby an application fluid for an intermediate layer was adjusted.

This application fluid was filled into an application tank, and a drum-shaped conductive base made of aluminum having a diameter of 30 mm and a full length of 245.3 mm as the conductive base 110 was immersed therein, pulled up and naturally dried, whereby the undercoat layer 41 as an intermediate layer having a film thickness of 1 μm was formed.

Then, an application fluid for a charge generating layer obtained by mixing 1 pt. wt of titanyl phthalocyanine and 1 pt. Wt. of butyral resin (produced by Denki Kagaku Kogyo K. K.: #6000-C) into 98 pts. wt. of methyl ethyl ketone and subjecting to a dispersion process in a paint shaker was applied onto the intermediate layer and naturally dried, whereby the charge generating layer 42 having a film thickness of 0.4 μm was formed.

Subsequently, by mixing 100 pts. wt. of butadiene compound (1,1-bis (p-diethylaminophenyl)-4,4-diphenyl-1,3-butadiene) (T405 produced by Anan), 160 pts. wt. of polycarbonate resin (produced by Mitsubishi Gas Chemical Co., Inc.: PCZ400) and 5 pts. wt. of 2,6-bis-tert-butyl-4-methyl phenol (produced by Sumitomo Chemical Co., Ltd.: sumilizer BHT), and using tetrahydrofuran as a solvent, an application fluid for a charge transfer layer having solid content of 21 wt % was made, applied onto the charge generating layer 42, and dried for one hour at 110° C., whereby the charge transfer layer 43 having a film thickness of 21 μm was formed, and the electrophotographic photoreceptor was obtained.

Next, by fixing a noncontact IC chip 1 (produced by Hitachi Maxell, Ltd.) with an antenna of 2.5 mm×2.5 mm by an adhesive in a position 5 mm away from one end in the axial direction of the electrophotographic photoreceptor on the surface of the photosensitive layer 120, that is, the surface of the charge transfer layer 43, the electrophotographic photoreceptor of layer construction shown in FIG. 4 was produced. More specifically, the noncontact IC chip was fixed onto the outer periphery of the electrophotographic photoreceptor. Next, flanges were attached onto both ends thereof, whereby an evaluation sample was obtained.

On the other hand, a reader/writer module was installed on a frame of a process cartridge of a copier on the market (AL1241 produced by Sharp Carporation), near a position where information of the noncontact IC chip 1 could be read and written in, and converted so as to write in a value of a total counter of the main body while a copy process was idling.

The produced electrophotographic photoreceptor was mounted into this converted copier, and ten thousand sheets were used. Then, when the total counter on the main body side and the number of copy sheets recorded on the IC chip 1 on the photoreceptor were compared, the numerical values agreed with each other.

Furthermore, when this photoreceptor was remounted into another copier converted in the same manner, information of the noncontact IC chip 1 was read by the main body side, and the total counter of the main body comes to a state of ten thousand sheets.

EXAMPLE 2

After the conductive base 110 was washed and dried, the noncontact IC chip 1 was fixed by an adhesive in a position 5 mm away from one end in the axial direction on the surface of the conductive base 110. By the immersion application method as in the example 1, the photosensitive layer 120 was produced. However, application was performed so as not to immerse the IC chip installing side defined as an upper end into an application fluid, whereby an electrophotographic photoreceptor of construction shown in FIG. 5 was produced. In this electrophotographic photoreceptor, the noncontact IC chip 1 was disposed away from the photosensitive layer 120, and fixed onto the periphery of the conductive base 110.

The electrophotographic photoreceptor produced in this manner was mounted into a copier and evaluated in the same manner as in the example 1, and the same result was obtained.

EXAMPLE 3

After the conductive base 110 was washed and dried, the noncontact IC chip 1 was fixed by an adhesive in a position 5 mm away from one end in the axial direction on the surface of the conductive base 110. More specifically, the noncontact IC chip 1 was fixed onto the periphery of the conductive base 110. In the immersion application method as in the example 1, the photosensitive layer 120 was produced. However, the undercoat layer 41 serving as an intermediate layer and the charge generating layer 42 were applied so that the IC chip installing side defined as an upper end was not immersed, and on the contrary, the IC chip installing side was defined as a lower end when the charge transfer layer 43 was applied, whereby an electrophotographic photoreceptor of construction shown in FIG. 6 was produced. In this electrophotographic photoreceptor, the noncontact IC chip 1 was coated with the charge transfer layer 43.

The electrophotographic photoreceptor produced in this manner was mounted into a copier and evaluated in the same manner as in the example 1. Consequently, it was confirmed that since the noncontact IC chip 1 was protected by a coating film of the charge transfer layer formed thereon, there was no occurrence of a scratch or the like and good communication was performed.

EXAMPLE 4

A conductive base (a saturated polyester resin made by adding graphite having a weight ratio of 30% and kneading (Lumirror, a molded body produced by Toray Industries, Inc.)) made by injection molding so as to have a diameter of 30 mm, a length of 245.3 mm and a wall thickness of 3 mm was washed by water containing a surface-active agent, subsequently washed out by pure water, and dried.

In a position 5 mm away from one end in the axial direction of the conductive base 210, a recession 2.5 mm square having a depth of 1 mm was made by a cutter. In this recession, the noncontact IC chip 1 was buried and fixed by an adhesive. Next, by the immersion application method as in the example 2, an electrophotographic photoreceptor of construction shown in FIG. 7 was produced, and evaluated in the same manner as in the example 1.

Consequently, it was confirmed that there was no convex part on the surface of the photoreceptor, toner scattering, disarrangement of napping of a developer and so on were not seen, and a good image was obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electrophotographic photoreceptor used in an electrophotographic image forming apparatus for forming an image on a recording medium, the electrophotographic photoreceptor comprising:

a conductive base;

a photosensitive layer formed on the conductive base;

a noncontact information medium disposed on the conductive base or photosensitive layer, the noncontact information medium being provided with an antenna part which communicates with main body communication means of a main body of the electrophotographic image forming apparatus in a noncontact state via electromagnetic waves and a control part including a memory which stores management information for managing the electrophotographic photoreceptor and controls the antenna part so as to communicate with the main body communication means; and wherein the noncontact information medium includes a resonance circuit comprising a coil electrically connected to a capacitor, wherein the resonance circuit transmits the electromagnetic saves from the coil to the main body communication means using at least one frequency based at least on a capacitance of the capacitor.

2. The electrophotographic photoreceptor of claim 1, wherein the noncontact information medium stores at least one of information of number of use of the electrophotographic photoreceptor, information of use conditions of the electrophotographic photoreceptor in the main body, ID information of a manufacturer of the electrophotographic photoreceptor, and information of inspection history of the electrophotographic photoreceptor.

3. The electrophotographic photoreceptor of claim 1, wherein the control part and the antenna part of the noncontact information medium are made up by one IC chip.

4. The electrophotographic photoreceptor of claim 1, wherein the electrophotographic photoreceptor comprises authentication means for authenticating access information inputted from the main body communication means, and access control means for allowing communication between the noncontact information medium and the main body communication means when the access information is authenticated by the authentication means.

5. The electrophotographic photoreceptor of claim 1, wherein the noncontact information medium is fixed to the surface of the photosensitive layer of the electrophotographic photoreceptor.

6. The electrophotographic photoreceptor of claim 1, wherein the noncontact information medium is fixed to the surface of the conductive base of the electrophotographic photoreceptor.

7. The electrophotographic photoreceptor of claim 1, wherein the conductive base is a resin.

8. The electrophotographic photoreceptor of claim 1, wherein a fixture position of the noncontact information medium on the electrophotographic photoreceptor exists outside all areas of charging means for charging the electrophotographic photoreceptor, developing means for developing an electrostatic latent image formed on the electrophotographic photoreceptor, transferring means for transferring a developed image to a recording medium, and cleaning means for removing toner residue.

9. The electrophotographic photoreceptor of claim 1, wherein the photosensitive layer includes an undercoat layer disposed onto the conductive base, a charge generating layer disposed onto the undercoat layer, and a charge transfer layer disposed onto the charge generating layer, and the noncontact information medium is fixed to the surface of the charge transfer layer.

10. The electrophotographic photoreceptor of claim 1, wherein the photosensitive layer includes an undercoat layer disposed onto the conductive base, a charge generating layer disposed onto the undercoat layer, and a charge transfer layer disposed onto the charge generating layer, and the noncontact information medium is fixed to the surface of the conductive base and disposed away from the photosensitive layer.

11. The electrophotographic photoreceptor of claim 1, wherein the photosensitive layer includes an undercoat layer disposed onto the conductive base, a charge generating layer disposed onto the undercoat layer, and a charge transfer layer disposed onto the charge generating layer, and the noncontact information medium is fixed to the surface of the conductive base and coated with the charge transfer layer.

12. A management system used in a main body of an image forming apparatus which main body accommodates an electrophotographic photoreceptor, comprising:

the electrophotographic photoreceptor of claim 1; and a mechanism for rewriting or reading information of the noncontact information medium, wherein communication with the noncontact information medium is carried out when a charge voltage to charging means for charging the electrophotographic photoreceptor and a development voltage to developing means for developing an electrostatic latent image formed on the electrophotographic photoreceptor are not applied.

13. A management system used in a main body of an image forming apparatus which main body accommodates an electrophotographic photoreceptor, comprising:

the electrophotographic photoreceptor of claim 1; and a mechanism for rewriting and reading information of the noncontact information medium, wherein when according to a judgment on the main body side, information stored in the noncontact information medium is judged as being abnormal, a necessary action is taken.

14. The electrophotographic photoreceptor of claim 1, wherein the noncontact information medium further comprises a power source circuit and a logic control circuit, wherein the power source circuit is located between the logic control circuit and the resonance circuit.

15. The electrophotographic photoreceptor of claim 1, wherein the noncontact information medium further comprises a timing circuit and a logic control circuit, and wherein the logic control circuit is located between the memory and the timing circuit so that the timing circuit supplies a timing signal to the logic control circuit.

16. An electrophotographic photoreceptor used in an electrophotographic image forming apparatus for forming an image on a recording medium, the electrophotographic photoreceptor comprising:

a conductive base;

a photosensitive layer supported by the conductive base;

a noncontact information medium disposed on the conductive base or photosensitive layer, the noncontact information medium being provided with an antenna part which communicates with an external device of the electrophotographic image forming apparatus in a noncontact manner via electromagnetic waves and a control part including a memory which stores management information for managing the electrophotographic photoreceptor and controls the antenna part so as to communicate with the external device; and wherein the noncontact information medium includes a resonance circuit comprising a coil electrically connected to a capacitor, wherein the resonance circuit transmits the electromagnetic waves from the coil to the external device using at least one frequency based at least on a capacitance of the capacitor.

* * * * *